US006170371B1

(12) United States Patent
Cote et al.

(10) Patent No.: US 6,170,371 B1
(45) Date of Patent: Jan. 9, 2001

(54) APPARATUS FOR TRANSPORTING SIGNATURES

(75) Inventors: Kevin Lauren Cote, Durham; Richard Daniel Curley; James Richard Belanger, both of Dover, all of NH (US)

(73) Assignee: Heidelberger Druckmaschinen AG (DE)

( * ) Notice: Under 35 U.S.C. 154(b), the term of this patent shall be extended for 0 days.

(21) Appl. No.: 09/153,225

(22) Filed: Sep. 15, 1998

Related U.S. Application Data

(62) Division of application No. 08/707,516, filed on Sep. 4, 1996, now Pat. No. 5,865,082.

(51) Int. Cl.[7] ..... B26D 1/00

(52) U.S. Cl. ..... 83/155; 83/155.1; 83/426; 83/435.2

(58) Field of Search ..... 83/155, 155.1, 83/426, 422, 435.2, 434; 271/272

(56) References Cited

U.S. PATENT DOCUMENTS

| | | | |
|---|---|---|---|
| 2,538,425 | 1/1951 | Nolan | 164/68 |
| 3,999,454 | 12/1976 | Tiso et al. | 83/107 |
| 4,344,610 | 8/1982 | Jeschke et al. | 270/6 |
| 4,432,746 | 2/1984 | DeHaan | 493/359 |
| 4,441,390 | 4/1984 | Hechler et al. | 83/154 |
| 4,811,641 | 3/1989 | Müller | 83/105 |
| 4,893,534 | 1/1990 | Köbler | 83/107 |
| 4,969,862 | 11/1990 | Ehlscheid | 493/359 |
| 5,029,842 | 7/1991 | Belanger et al. | 271/188 |
| 5,103,703 | 4/1992 | Littleton | 83/155 |
| 5,107,733 | 4/1992 | Palmatier et al. | 83/176 |
| 5,112,033 | 5/1992 | Breton | 270/47 |
| 5,363,728 | 11/1994 | Elsner et aal. | 83/23 |

FOREIGN PATENT DOCUMENTS

| | | |
|---|---|---|
| 1935909 | 6/1970 | (DE) . |
| 2056665 | 5/1972 | (DE) . |
| 4120629 | 12/1992 | (DE) . |
| 0031515 | 7/1981 | (EP) . |
| 0338260 | 10/1989 | (EP) . |
| 1326892 | 8/1973 | (GB) . |

*Primary Examiner*—M. Rachuba
(74) *Attorney, Agent, or Firm*—Burns Doane Swecker & Mathis LLP

(57) ABSTRACT

The present invention generally relates to transporting signatures within a folding apparatus. Exemplary embodiments include at least one pair of cooperating cutting cylinders, each having at least one of a knife and an anvil. A conveying plane extends in substantially vertical direction. A right and a left conveyor assembly are assigned to the conveying plane. The cooperating cutting cylinders are integrated into the paths of conveying elements of the left and right conveyor assemblies, seizing a web of material prior to a cutting operation.

5 Claims, 6 Drawing Sheets

15
18.3
19.3
18
18.2
19.2
19
18.1
19.1
23
24
20
20
17
16
26
28
27
25
27

25
19
15
30
30.1
30
30.1
30
30
18
31
18.3
18.2
31
24
24
18.1
31
30
24
23
23
23

APPARATUS FOR TRANSPORTING SIGNATURES

This application is a divisional of application Ser. No. 08/707,516, filed Sep. 4, 1996 now U.S. Pat. No. 5,865,082.

BACKGROUND OF THE INVENTION

1. Field of the Invention

The present invention relates to a method and apparatus for the dynamic guidance of flat products, such as flat products which are cut from a continuous web of material by a transversal cutting operation.

2. State of the Art

U.S. Pat. No. 5,029,842 discloses a signature handling apparatus including a first conveyor which sequentially moves signatures to a discharge station. At the discharge station, the signatures are sequentially transferred to a receiving conveyor. To increase the speed at which signatures can move between the first conveyor and the receiving conveyor, one or more corrugations are formed in the signatures to stiffen them. Accordingly, a corrugator assembly is located at the discharge station to stiffen the signatures by forming corrugations which extend between leading and trailing end portions of the signatures. Although the corrugations are only temporarily maintained in a signature, the corrugator assembly is close enough to the receiving conveyor that a corrugation is maintained in the signature, as the leading end portion of the signature moves to the receiving conveyor. That is, the corrugator assembly is spaced from the receiving conveyor by a distance which is less than the distance between the leading and trailing end portions of the signatures.

U.S. Pat. No. 5,107,733 discloses an apparatus for cutting and transporting a paper web in a folding apparatus of a printing press. The apparatus includes a pair of cutting cylinders for cutting web sections from the web, and a transporting device for transporting the web sections away from the cutting cylinders. The first cutting cylinder has at least one cutting anvil, and the second cutting cylinder has at least one cutting knife which meets the cutting anvil at a nip between the cutting cylinders to cut the web moving through the nip. A plurality of strips are supported on each of the first and second cutting cylinders. The strips have positions on the cutting cylinders in which they impress a temporary reinforcing profile onto each of the newly formed leading portions of the web when the strips move through the nip. The reinforcing profile is imparted to each leading portion of the web to assist in guiding the leading portion as it moves from the nip between the cutting cylinders toward the transporting device. In addition to the strips, at least one smoothing surface is also supported on each of the first cutting cylinder and the second cutting cylinder. The smoothing surfaces have positions on the cutting cylinders wherein the smoothing surfaces remove the temporary reinforcing profile from the leading portions of the web when the smoothing surfaces move through the nip.

Despite the existence of signature handling devices as described above, there has been encountered the technical problem that upon severing signatures from a continuous web during its transport to conveyor tapes, positive control of the signature is lost. After the lead edge of the signature is cut, it is fed into the in-running nip of the conveying tapes. However, geometric constraints preclude the conveying tapes from gaining control of a signature until the signature has travelled past the cutting cylinders. A crucial zone for each signature's lead edge therefore extends from behind the cutting nip to a point before the conveyor tapes gain control of the lead edge. The lead edge of the signature is unconstrained during this distance, so it can deviate from a desired straight path into the transport tapes. Particularly, in pinless folders, the signatures often deviate along curved paths instead of following an intended straight path from the cutting cylinders to the conveying tapes. These deviations can result in variations of distance between the signatures conveyed, thereby causing difficulties in further processing the signatures in a pinless folder.

Another drawback of existing cutting cylinder to tape transfers is the signatures' lead edges being blown open. This unintended opening of a signature's leading edge can cause processing jams or product damage, such as dog ears or the like.

Additional corrugating devices, such as those disclosed in U.S. Pat. No. 5,107,733, have also been used with cutting cylinders. Furthermore, the use of electrostatic tackers upstream from the cutting cylinders has been proposed to address the problems which occur during the transfer of signatures. However, these solutions cause other problems, and render the signature transfer area between cutting cylinders and conveyor tapes a rather sensitive area within a pinless folder.

SUMMARY OF THE INVENTION

Given the state of the art as described above, and the associated problems encountered in the technical field, it is accordingly an object of the present invention to provide positive control of signatures severed from a web of material while the signatures travel between a cutting nip and an in-running nip of conveyor tapes.

A further object of the present invention is to maintain relatively constant distance between signatures severed from the web of material during their transport through the conveyor tapes.

Another object of the present invention is to prevent lead edges of signatures from blowing open during their transport.

According to exemplary embodiments of the present invention, an apparatus for transporting signatures within a folding apparatus comprises at least one pair of cooperating cutting cylinders, each of said cutting cylinders having at least one of a knife and an anvil bar; a conveying plane which extends substantially vertically during operation; and a first conveyor assembly and a second conveyor assembly, said cooperating cutting cylinders being integrated into paths of conveying elements of said first conveyor assembly and said second conveyor assembly for seizing a web of material prior to a cutting operation performed by said cooperating cutting cylinders.

Exemplary embodiments also relate to a method for transporting signatures of a folding apparatus comprising the steps of conveying said web of material through a transverse cutting plane using at least first and second conveyor assemblies which seize said web of material in both an input area and an output area of said transverse cutting plane; and actively driving said seized web of material into a finger-shaped guide located downstream of said first and second conveyor assemblies.

Exemplary embodiments according to the present invention allow for positive control of the web from both sides thereof, prior to severing signatures from the leading edge of the web of material in the cutting nip. Since longitudinally folded signatures are seized and kept together, blowing open of signature lead edges is reduced and/or eliminated.

Further, since an area extending from the cutting nip to an in-running nip of conveyor tapes is bridged by the conveyor assemblies, a deviation of signature lead edges is eliminated, and a constant distance between each sequential signature is maintained.

According to further details of the present invention, the conveying elements can either be arranged in groups of any number (e.g., two or three), each group of conveying elements being spaced apart from the following group of conveying elements—and/or the conveying elements can be individually arranged on the paths of the conveyor assemblies.

The arrangement of conveying elements in groups of at least two or three conveying elements has advantages in the lower region of the conveying plane, at the out running nip thereof. The second and/or third conveying elements of each group exert a positive drive upon signatures when travelling into a lower pair of belts.

The conveying elements—either arranged in groups and/or individually—are connected to each other by linking elements forming a closed loop on each conveyor assembly. The conveyor elements can, for example, be cross bars extending over the width of the web of material, the cross bars having guiding discs spaced apart from each other. Alternately, the conveyor elements can, for example, be endless belts having cutouts arranged on their circumference. The pair of cutting cylinders have segments of reduced radius allowing the conveying elements to pass, the cutting cylinders being integrated into the paths of the conveying elements. The segments of reduced radius constitute an arc-shaped recess on the cylinders. Prior to the transversal cut of the web of material in a cutting plane which is transverse to the conveying plane, the material is seized by the conveying elements from both sides thereof.

In a downstream area of the out running nip of the conveyor assemblies, at least one pair of guide fingers is arranged. The guide fingers enter the empty spaces between the guiding discs of the rotating cross bars to allow for a straight movement (e.g., straight vertically downward movement) of the signatures.

In the alternate embodiment mentioned above, the endless belts have cutouts arranged on their circumferences to allow for cooperation between the pair of cutting cylinders. The endless belts substantially extend over the width of the web of material to provide for a positive control of the signatures being severed from the web of material. The endless belts are driven in phase with respect to the rotation of the pair of cutting cylinders, and further at a speed with which the web of material is conveyed.

BRIEF DESCRIPTION OF THE DRAWINGS

The foregoing and other objects and features of the present invention will become more apparent from the following detailed description of preferred embodiments when read in connection with the accompanying drawings, wherein.

DETAILED DESCRIPTION OF PREFERRED EMBODIMENTS

Figure 1:
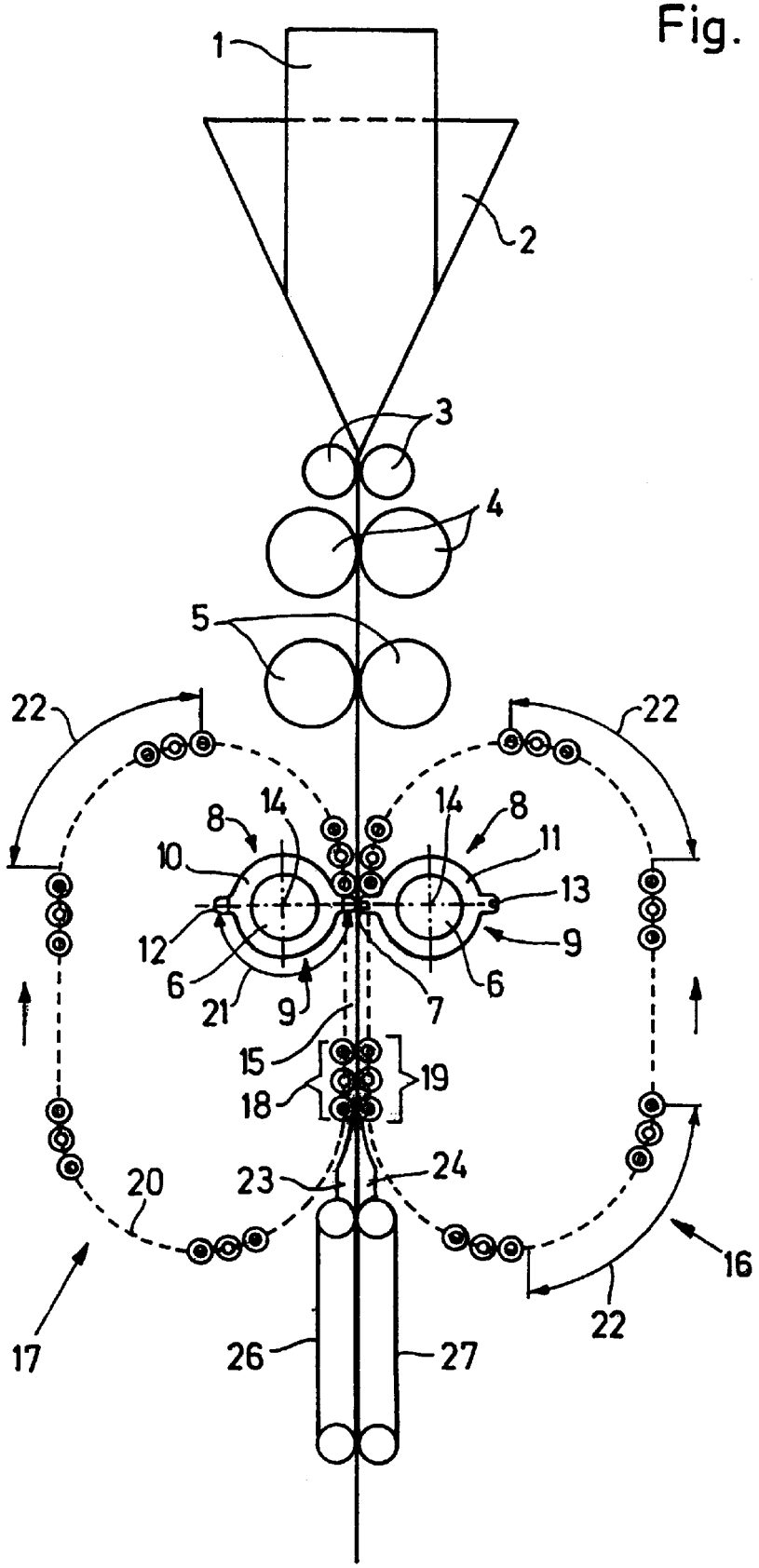
FIG. 1 is a schematic view of two conveyor assemblies assigned to a substantially vertically extending conveying plane.

In FIG. 1, a web of material (e.g., ribbon) 1 is pulled over a former 2 by means of nip rollers 3 in a longitudinal direction. The longitudinally folded web of material 1 then passes a pair of first draw rollers 4 and a pair of second draw rollers 5. After passing the second pair of draw rollers 5, the web of material 1 passes a pair of cutting cylinders 6 rotating around an axis of rotation 14 including a knife cylinder 10 and an anvil (e.g., rubber) cylinder 11, each having at least one of a knife 12 and an anvil bar 13. In a nip 7 of the cutting cylinders, signatures are severed from the web of material 1 via the cutting cylinders which perform a traversal cutting operation in a cutting plane which is transverse with respect to a conveying plane.

Figure 2:
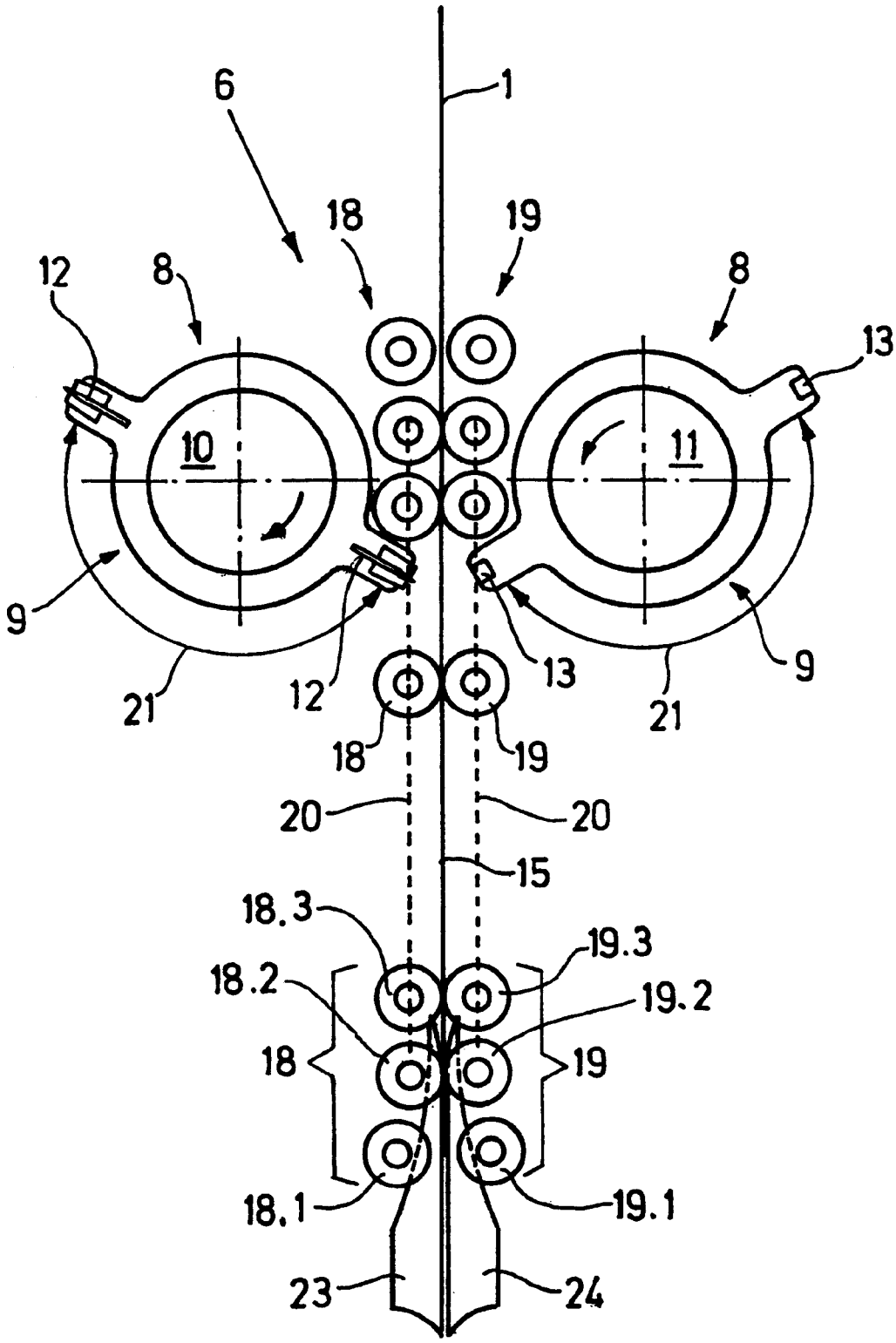
FIG. 2 is an enlarged view of the cutting cylinder section.

Prior to the transversal cutting operation, the web of material 1 is seized on both sides by conveying elements 18 and 19 of a first (e.g., left) conveyor assembly 17 and a second (e.g., right) conveyor assembly 16, respectively. In the FIG. 1 embodiment, the conveying elements 18, 19 are arranged in groups having a first, a second and a third conveying element. As shown in FIG. 2, 18.1, 18.2 and 18.3 constitute a group of conveying elements on the left conveyor assembly 17, whereas the corresponding first, second and third conveying elements 19.1, 19.2 and 19.3 are those of the right conveyor assembly 16. On the paths of the left and right conveyor assemblies 16, 17, the groups of conveying elements 18, 19 are spaced apart from each other as indicated by the arrow 22 of FIG. 1. The conveying elements 18, 19 are linked with each other by linking elements 20. In an alternate embodiment, the conveying elements need not be formed in groups, but can be formed as individual conveying elements, or as any combination of individual conveying elements and groups of conveying elements.

The web of material 1 is seized by the groups of conveying elements 18, 19 above the pair of cutting cylinders 6. To engage the web of material 1 as it travels along the conveying paths of both conveyor assemblies 16, 17 in the conveying plane 15, which in the FIG. 1 illustration extends substantially vertically during operation of the device, the groups of conveying elements 18, 19 pass between the knife cylinder 10 and the anvil cylinder 11 by diving into segments of these cylinders which have a reduced radius relative to other segments of the cylinders. The first and second arc-shaped recesses 8, 9 on each of the pair of cylinders 6 allow the conveying elements 18, 19 to engage the web of material 1 in an input area located prior to the nip 7, and to engage a severed signature 25 in an output area downstream of the nip 7 after the signature has been severed from the web of material 1. Thus, positive control of the severed signatures 25 is maintained.

In an area downstream of the left and right conveyor assemblies 16 and 17, finger-shaped guides 23, 24 are mounted to establish correct signature entry into left and right conveyor belts 26, 27 respectively.

FIG. 2 shows an enlarged view of the cutting cylinders with the pair of cutting cylinders 6 being integrated into the path of the groups of conveying elements 18, 19 respectively. The groups of conveying elements 18, 19 engage the web of material 1 prior to the pair of cutting cylinders 6. To keep their close contact to the web of material 1 being conveyed, the groups of conveying elements 18, 19, and/or the individual conveying elements 18, 19, dive into the first and second arc-shaped recesses 8, 9 on each cylinder of the pair of cutting cylinders 6, after the cooperating knives 12 and anvil bars 13 have severed a signature from the web of material 1. The arc lengths of the first and second recesses 8, 9, in a circumferential direction on the knife cylinder 10 and the anvil cylinder 11, are indicated in FIG. 2 by reference numeral 21. The recesses 8, 9 (i.e., the segments with reduced radius) extend from one knife 12 to the next knife 12 on the knife cylinder 10, and from one anvil bar 13 to the next anvil bar 13 on the anvil cylinder 11.

Thus, the web of material 1 is guided, prior to the transversal cutting operation, by the groups of conveying elements 18, 19. Further, the severed signature is prevented from blowing open at the leading edge thereof, and cannot deviate from the substantially vertically extending conveying plane 15. Consequently, the distance between successive signatures severed from the web of material 1 is maintained constant, and deviations from the intended conveyance path are reduced or eliminated.

As mentioned previously, a lower portion of the left and right conveyor assemblies 16, 17 (i.e., the out running nip thereof), includes two finger-shaped guides, or guiding elements, 23, 24. The groups of conveying elements 18, 19 which comprise elements 18.1, 18.2, 18.3, or 19.1, 19.2, 19.3 respectively, follow conveyance paths into the lower section of conveyor assemblies 16, 17, with respective paths of the conveying elements guiding the leading edge of each signature to the vertically extending nip between the guiding elements 23, 24.

At a stage shown in the exemplary FIG. 2 embodiment, the leading edge of each signature is controlled by the second and third conveying elements 18.2, 18.3 and 19.2, 19.3 respectively, whereas the trailing edge is controlled by the individually arranged conveying elements 18, 19 shown in FIG. 2. The web of material 1 above the pair of cutting cylinders 6 is seized by groups of conveying elements 18, 19 which have partially entered the first recess 8 assigned to the knife cylinder 10 and the anvil cylinder 11.

Figure 3:
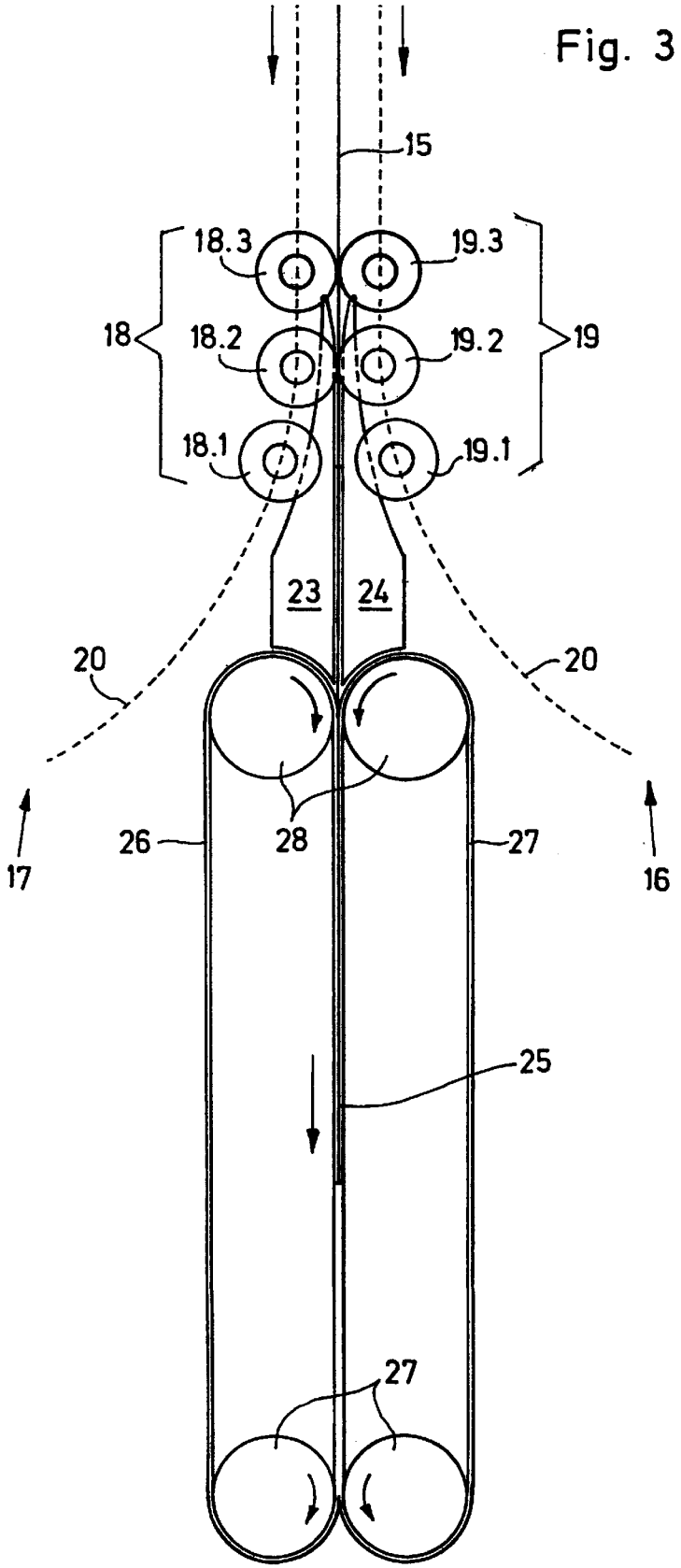
FIG. 3 is an enlarged view of the out running nip section of the conveyor assemblies.

FIG. 3 is an enlarged view of the out running nip section of the conveyor assemblies. Each signature 25 which is conveyed in the conveying plane 15 is seized at its leading edge by groups of conveying elements 18.1, 18.2, 18.3 and 19.1, 19.2, 19.3, respectively. The groups of conveying elements 18, 19 insert the leading edge of the signature into the nip between the pair of finger-shaped guides 23, 24. The preceding signature 25 is shown as being under control of the left and right conveying belts 26, 27 respectively. Upon further movement of the conveying elements 18.1, 18.2, 18.3 and 19.1, 19.2, 19.3, the first conveying elements 18.1, 19.1 each tend to follow the paths of the conveyor assemblies 16, 17. The second and third conveying elements 18.2, 18.3 and 19.2, 19.3 exert a positive drive upon a signature 25 to drive it into the nip between the finger-shaped elements 23, 24. Since the distance between the pinchpoint of the third conveying elements 18.3 and 19.3 and the positive drive of the lower belts 26, 27 is less than the length of the signature 25, a positive drive of the severed signature 25 in the transfer region is maintained.

The lower belts 26, 27 rotate about rollers 28 to transport the signatures 25 to further processing stations. In an area at the tips of the finger-shaped elements 23, 24 where the conveying elements 18, 19 approach, the tips of the finger-shaped elements 23, 24 enter into gaps between guiding discs of the conveying elements 18, 19 shown in greater detail in FIG. 4.

Figure 4:
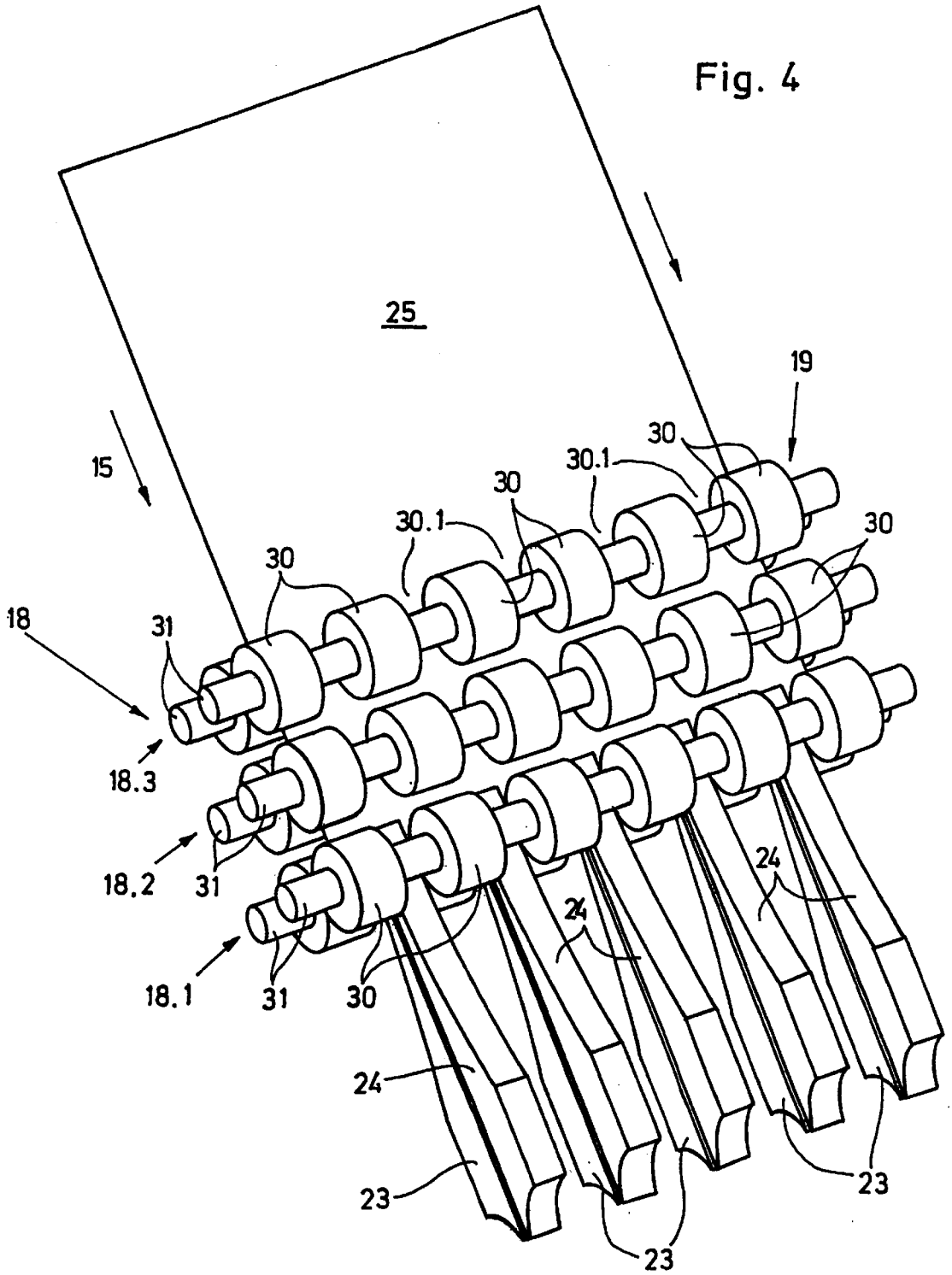
FIG. 4 shows finger-shaped guides entering gaps between guiding discs on cross bar shaped conveying elements.

FIG. 4 shows conveying elements 18, 19 shaped as cross bars 31 having guiding discs 30 mounted thereon, which are spaced apart from each other. The finger-shaped guides enter the gaps between the guiding discs and cross bar shaped elements. In this perspective view, the tips of the finger-shaped guide elements 23, 24 enter gaps 30.1 between guiding discs 30. The guiding discs 30 are arranged spaced apart from each other, allowing the tips of the guide elements 23, 24 to be inserted between members of the groups of conveying elements 18, 19. After inserting a signature lead edge into the nip between the finger-shaped guide elements 23, 24, the second and third conveying elements 18.2, 18.3 and 19.2, 19.3, drive the signature 25—exerting positive control on it—fully into the nip between the finger-shaped elements 23, 24. Thus, the finger-shaped guide elements 23, 24 provide control over the signature before the conveying elements 18.3, 19.3 release control of the signature 25.

The guiding discs 30 can be formed of, for example, rubber or synthetic materials which generate and transmit a frictional force upon the leading edge of a signature which is seized on both sides thereof. Of course, any material which provides the desired frictional contact can be used.

Figure 5:
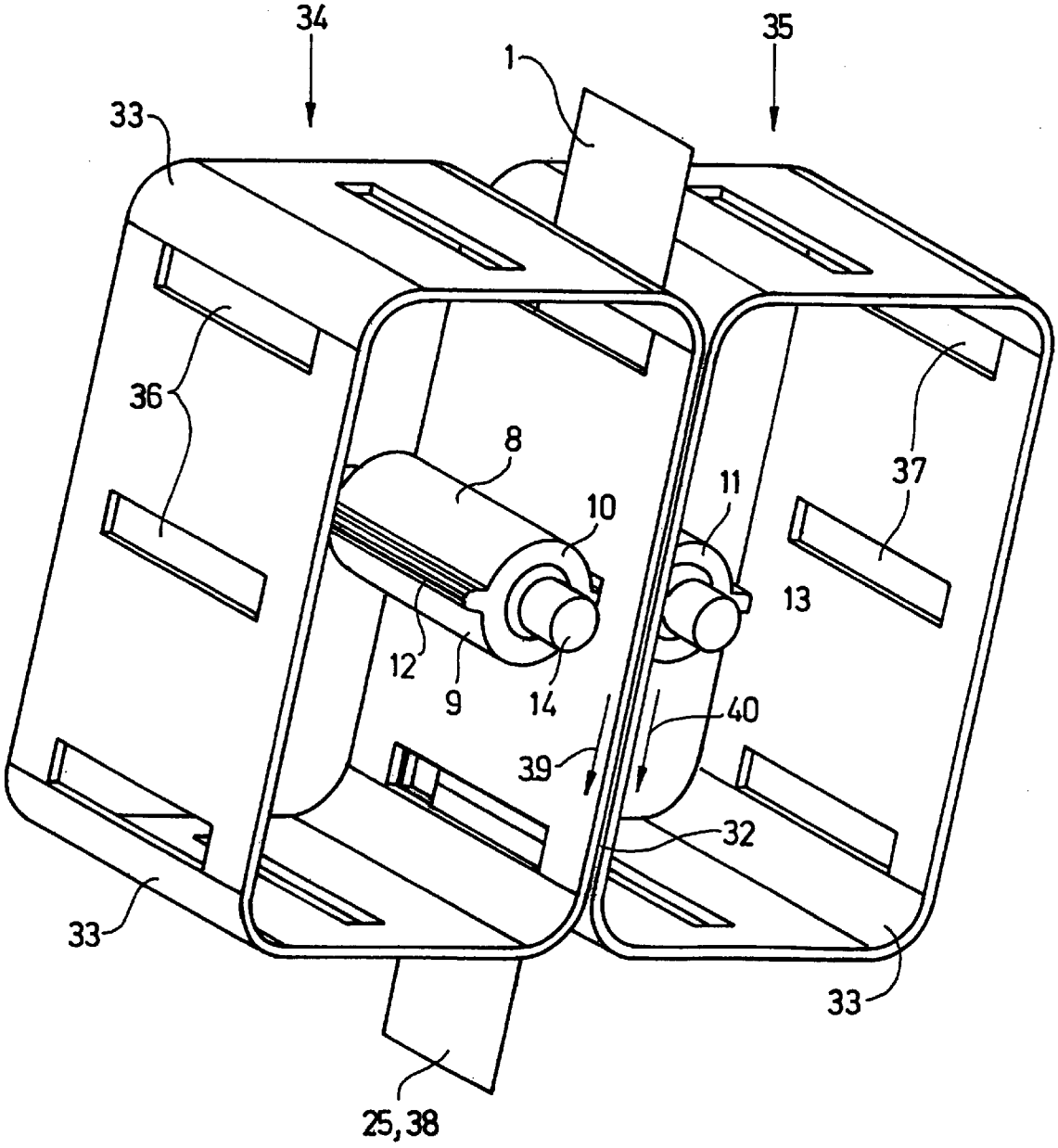
FIG. 5 shows an alternate embodiment of the conveyor assemblies being endless belts having cutouts shaped therein.
Figure 6:
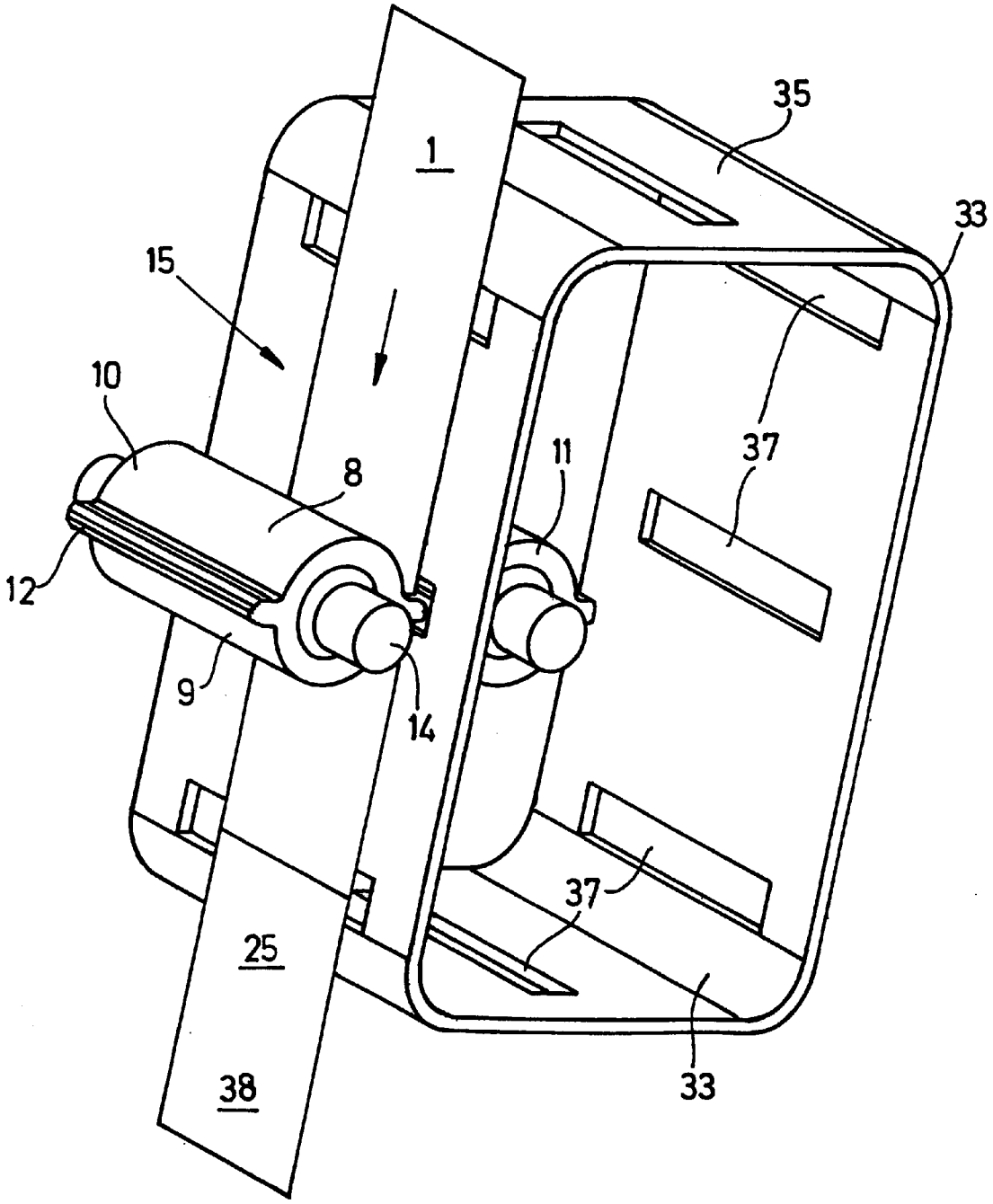
FIG. 6 shows the endless belts guiding the web of material and signatures severed from the web of material.

FIGS. 5 and 6 show an alternate embodiment of the conveying elements, wherein the conveying elements are shaped as endless belts, the widths of which, in an exemplary embodiment, extend over the width of the web of material 1. As those skilled in the art will appreciate, belts of any desired width can be used in alternate embodiments. The cutting cylinders—i.e., a knife cylinder 10 and an anvil cylinder 11—are each surrounded by one of the endless belts 34, 35 respectively. The rollers, about which the endless belts 34, 35 rotate, are omitted from the drawing for the purpose of simplifying the illustration. The knife cylinder 10 and anvil cylinder 11 each have first and second arc shaped recesses 8, 9 assigned thereto, such that the endless belts 34, 35 maintain positive signature control during the severing of the signatures 25, 38. The endless belts 34 and 35, which rotate in phase with respect to the knife and the anvil cylinders 10 and 11, are provided with rectangular shaped cutouts 36, 37 to allow the cutting cylinders 10, 11 to perform transversal cuts.

The endless belts 34, 35 rotate in a direction of arrows 39, 40. The guiding rollers of the endless belts—although not shown here—are arranged in the curvature sections 33 of each endless belt 34, 35 in any manner readily apparent to those skilled in the art. The endless belts 34, 35 rotate with the speed of the web of material 1 and provide a positive control of the signatures 25, 38 severed from the web of material 1. Since the rotating endless belts 34, 35 seize a web of material 1 prior to the transversal cut, and seize signatures 25, 38 during and after the cut, deviations of the signatures 25, 38 are eliminated. Furthermore, the spacing between the severed signatures 25, 38 can be maintained at a preset distance.

It will be appreciated by those skilled in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. An apparatus for transporting signatures comprising:

at least one pair of cooperating cutting cylinders, one of said pair of cooperating cutting cylinders having at least one knife and the other of said pair of cooperating cutting cylinders having at least one anvil bar; and a first conveyor assembly and a second conveyor assembly, said cooperating cutting cylinders being integrated into closed loop paths of said first conveyor assembly and said second conveyor assembly for seizing a web of material prior to a cutting operation performed by said cooperating cutting cylinders, wherein said first and second conveyor assemblies are endless belts which transport the signatures in a substantially vertically extending conveying plane.

2. An apparatus according to claim 1, wherein each of said endless belts further includes:

cutouts for said pair of cooperating cutting cylinders to cut signatures from said web of material.

3. An apparatus according to claim 1, wherein each of said endless belts has a width which extends over a width of said web of material.

4. An apparatus according to claim 1, wherein said endless belts are driven in phase with said pair of cooperating cutting cylinders and at speed with which said web of material is conveyed.

5. An apparatus for transporting a leading edge of a web material, said apparatus comprising:

a conveying plane in which a web of material is transported;

at least one pair of cooperating cutting cylinders, each of said cutting cylinders having at least one of a knife and an anvil, said cutting cylinders establishing a cutting plane transverse to said conveying plane; and a first conveyor assembly and a second conveyor assembly, said cooperating cutting cylinders being integrated into paths of conveying elements of said first conveyor assembly and said second conveyor assembly for seizing a web of material prior to a cutting operation performed by said cutting cylinders; and a first finger-shaped guide and a second finger-shaped guide assigned to an out running nip of said first and second conveyor assemblies.

* * * * *